US010441085B1

(12) United States Patent
Singleton et al.

(10) Patent No.: US 10,441,085 B1
(45) Date of Patent: Oct. 15, 2019

(54) BED WITH CONFIGURABLE HEADBOARD

(71) Applicants: Blondell Singleton, Florence, SC (US); Major Singleton, Ewa Beach, HI (US); Marion Singleton, Simpsonville, SC (US); Datra Singleton, Landon, SC (US)

(72) Inventors: Blondell Singleton, Florence, SC (US); Major Singleton, Ewa Beach, HI (US); Marion Singleton, Simpsonville, SC (US); Datra Singleton, Landon, SC (US)

( * ) Notice: Subject to any disclaimer, the term of this patent is extended or adjusted under 35 U.S.C. 154(b) by 0 days.

(21) Appl. No.: 16/431,215

(22) Filed: Jun. 4, 2019

Related U.S. Application Data

(63) Continuation-in-part of application No. 15/425,939, filed on Feb. 6, 2017.

(51) Int. Cl.
*A61G 7/00* (2006.01)
*A47C 19/22* (2006.01)
*A47C 19/02* (2006.01)

(52) U.S. Cl.
CPC ..... *A47C 19/22* (2013.01); *A47C 19/022* (2013.01)

(58) Field of Classification Search
CPC ..... A61G 7/00
USPC ..... 5/53.1–53.3
See application file for complete search history.

(56) References Cited

U.S. PATENT DOCUMENTS 2,818,585 A * 1/1958 Campbell ..... A45D 19/04 297/182
4,081,867 A * 4/1978 Simeola ..... A45D 19/04 4/516
2013/0305459 A1* 11/2013 Kaiser ..... A47C 19/022 5/658

* cited by examiner

*Primary Examiner* — Frederick C Conley
(74) *Attorney, Agent, or Firm* — Gulf Coast Intellectual Property Group

(57) ABSTRACT

A bed having a headboard wherein the headboard includes an integrated sink so as to facilitate the execution of hygienic tasks for an individual disposed in the bed such as but not limited to washing of the individual's hair. The headboard includes a body that is planar in manner wherein the body includes a first end, a second end, a lower edge and an upper edge all combining to define the shape thereof. The body of the headboard is hingedly secured to the bed proximate the lower edge of the headboard. The headboard is movable between a first position and a second position. In the second position the headboard is horizontal in orientation. The sink is manufactured from a material and is formed in a shape that facilitates the moving of the sink between a first position and a second position.

2 Claims, 3 Drawing Sheets

BED WITH CONFIGURABLE HEADBOARD

CROSS REFERENCE TO RELATED APPLICATIONS

This application is a continuation-in-part of U.S. patent application Ser. No. 15/425,939 filed, Feb. 6, 2017, entitled, Bed having integrated hair washing station, which is hereby incorporated for reference.

FIELD OF THE INVENTION

The present invention relates generally healthcare apparatus, more specifically but not by way of limitation, a bed that is configured with a headboard that includes an integrated collapsible sink wherein the headboard is movable between a first position and a second position.

BACKGROUND

Millions of people suffer with illness for various time periods wherein during the illness the individuals are bed-ridden. Additionally, there are many elderly individuals that due to physical ailments must spend a significant portion of their time in bed. When individuals are either required to spend a n abundant time in bed or are unable to physically leave the bed, healthcare workers or other assistants must provide the necessary care. Caring for those individuals that are bed-ridden can be quite a challenge. Many times these individuals are obese which can make it difficult for a single aide help the individual out of bed to perform tasks such as but not limited to going to the bathroom. Additionally, for the individuals that are bed-ridden, daily hygiene tasks such as bathing an washing their hair can become very cumbersome.

One issue providing bed-ridden patients proper hygiene is the ability to cleanse the hair of the bed-ridden patient. While sponge baths and the like have proven effective for cleansing the body, it still presents a challenge to effectively wash the hair when a patient is in the bed.

Accordingly, there is a need for bed that is designed to provide a technique for a caretaker or aide to effectively wash and dry an individual's hair while they are in the bed.

SUMMARY OF THE INVENTION

It is the object of the present invention to provide a headboard operably coupled to a bed that is configured to provide a technique of washing the hair of an individual unable to be removed from the bed in which they are disposed.

Another object of the present invention is to provide a headboard operably coupled to a bed that is configured to facilitate the washing of the hair of an individual who is unable to remove themselves from the bed wherein the bed is configured with a headboard having a first position and a second position.

A further object of the present invention is to provide a headboard operably coupled to a bed that is configured to facilitate the washing of an individual's hair without the need to leave the bed wherein in the first position the headboard is vertical in orientation.

Still another object of the present invention is to provide a headboard operably coupled to a bed that is configured to facilitate the washing of an individuals hair without the need to remove the individual from the bed wherein in the second position the headboard is horizontal in orientation.

An additional object of the present invention is to provide a headboard operably coupled to a bed that is configured to allow a user's hair to be washed without the need for the user to be removed from the bed wherein the headboard includes an integrated sink in the center thereof.

Yet a further object of the present invention is to provide a headboard operably coupled to a bed that is configured to facilitate the ability for a person to wash an individual's hair whom is unable to leave the bed wherein the integrated sink is collapsible.

Another object of the present invention is to provide a headboard operably coupled to a bed that is configured to facilitate the washing of an individual's hair without the need to leave the bed wherein the integrated sink is movable intermediate a first position and a second position.

Still and additional object of the present invention is to provide a headboard operably coupled to a bed that is configured to allow a user's hair to be washed without the need for the user to be removed from the bed wherein the sink further includes a central aperture for drainage of water introduced thereinto.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
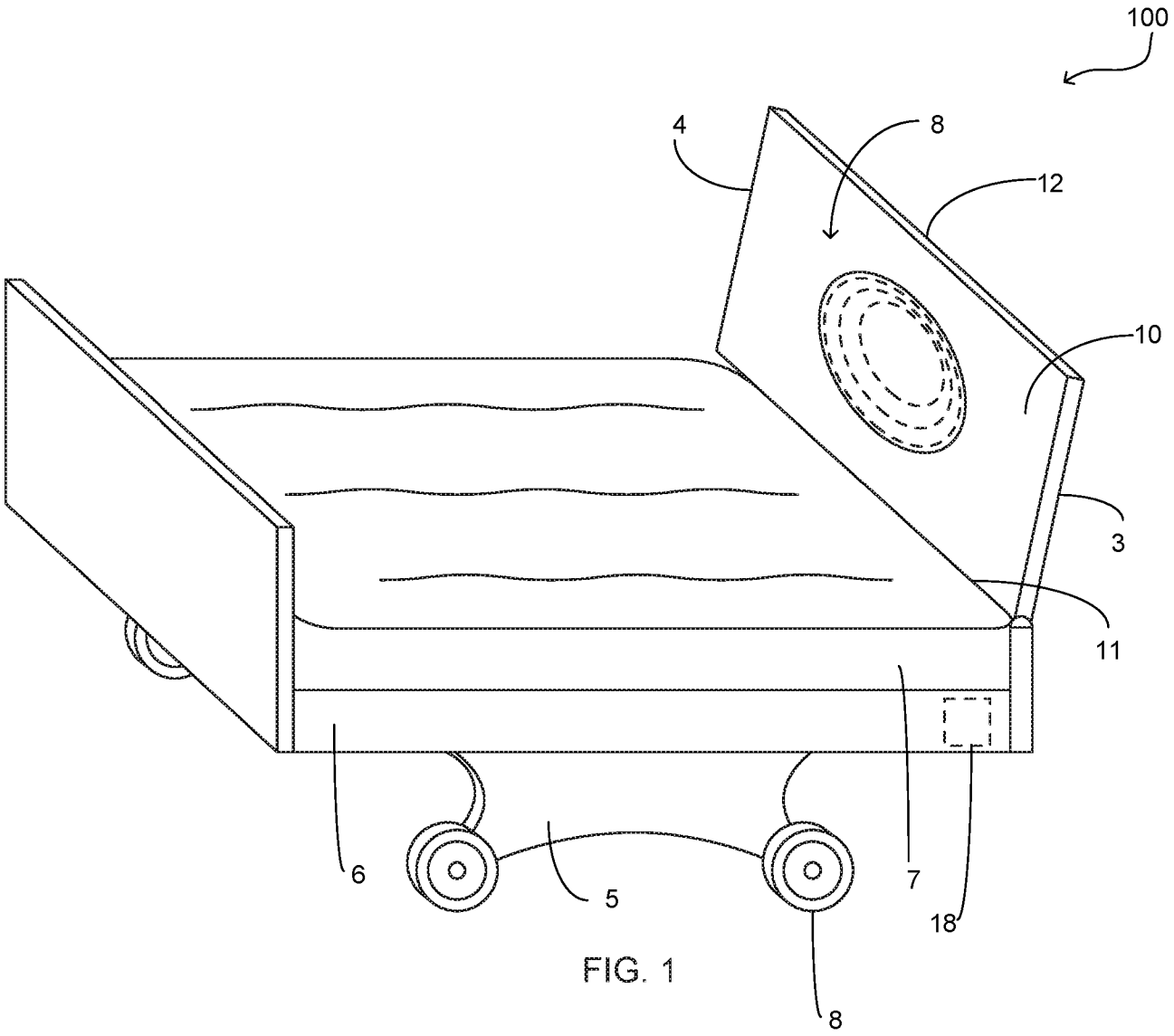
FIG. 1 is a perspective view of the present invention.

Referring now to the drawings submitted herewith, wherein various elements depicted therein are not necessarily drawn to scale and wherein through the views and figures like elements are referenced with identical reference numerals, there is illustrated a bed with configurable headboard 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring now in particular to FIG. 1, the bed with configurable headboard 100 includes a frame 5, box spring 6 and mattress 7 that are conventional in construction and mounted on wheels 8 in order to facilitate easier movement of the bed with configurable headboard 100. It is contemplated within the scope of the present invention that the box spring 6 and mattress 7 could be provided in the various conventional sizes such as but not limited to full size or queen size.

Hingedly secured to the frame 5 is a headboard 10. The headboard 10 extends the width of the mattress 7 and is manufactured from a suitable durable material such as but not limited to wood. The headboard 10 is hingedly secured to the frame 5 proximate the lower edge 11 of the headboard 10 utilizing suitable durable techniques such as but not limited to mechanical fasteners. The headboard 10 includes upper edge 12 defining a depth of the headboard 10 in conjunction with the lower edge 11. The headboard 10 is movable intermediate a first position and a second position. Illustrated in FIG. 1 herein, the headboard 10 is shown in its first position. In the first position the headboard 10 is oriented in a vertical manner providing the function of a conventional headboard. The first position of the headboard 10 allows the bed with configurable headboard 100 to be placed adjacent to a wall wherein the headboard 10 is parallel and adjacent thereto.

The headboard 10 includes a body 8 manufactured from a durable material such as but not limited to wood. The body 8 of the headboard 10 is planar in manner and includes first end 3 and second end 4. While the body 8 is illustrated as being rectangular in shape in the embodiment illustrated herein, it is contemplated within the scope of the present invention that the body 8 could be formed in alternate shapes.

Figure 2:
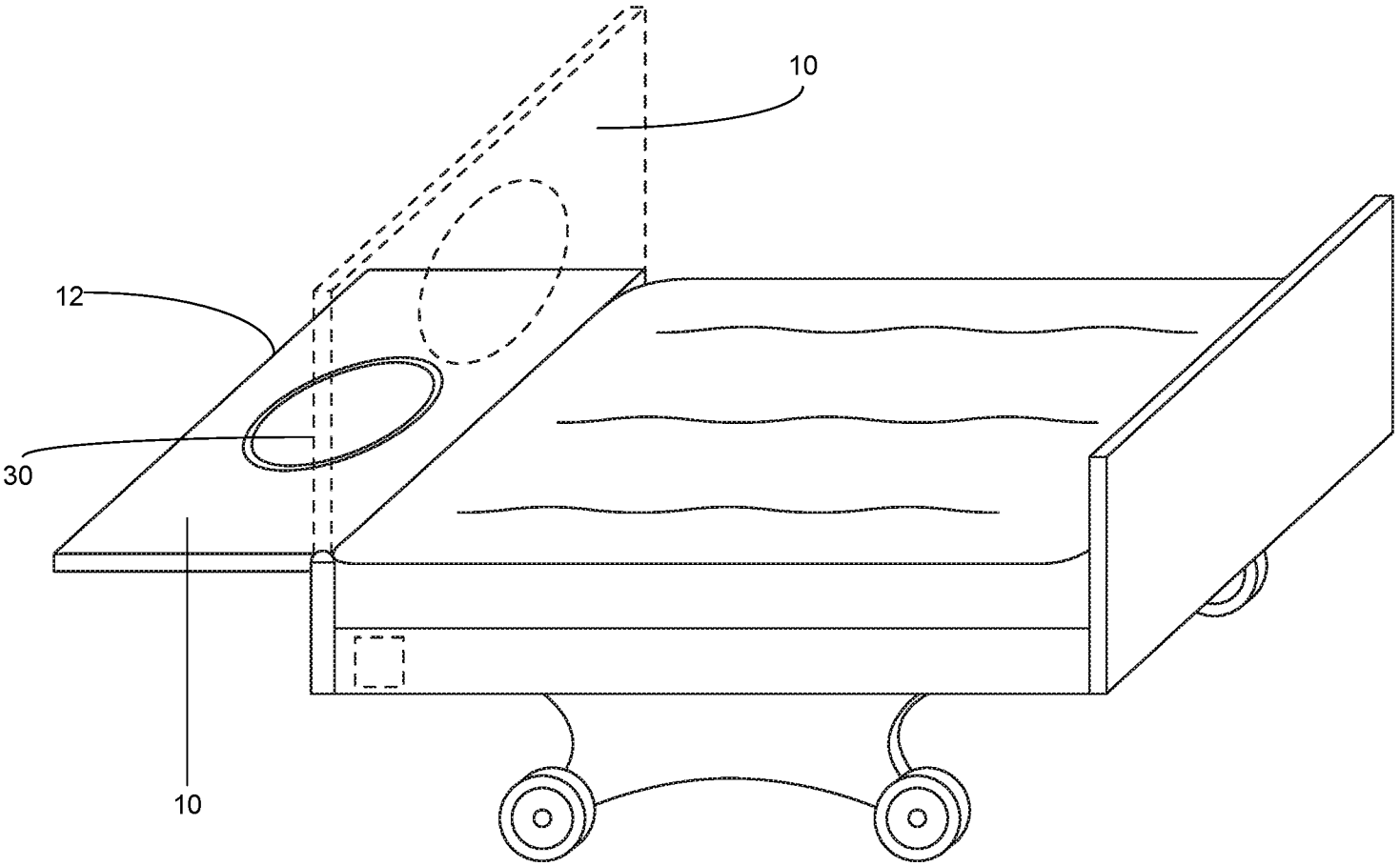
FIG. 2 is perspective view of the present invention illustrating the first and second position of the headboard.

Illustrated herein in FIG. 2, the headboard 10 is shown in its second position. In the second position the headboard 10 is moved approximately ninety degrees relative to the first position wherein the headboard 10 is oriented in a horizontal manner. As will be further discussed herein, in the second position the headboard 10 is positioned to allow for utilization of the sink 30 integrally mounted therein. Ensuing the headboard 10 being moved to its second position, a patient superposed on the mattress 7 can be moved in order to place their head over the sink 30. For patients that have limited mobility, the second position of the headboard 10 positions the sink 30 such that a caretaker can more easily accommodate the patient's immobility and provide hair washing or other hygienic activities. It should be understood within the scope of the present invention that the wheels 8 of the frame 5 facilitate movement of the bed with configurable headboard 100 in order to provide the required distance from a wall so as to place the headboard 10 in its second position.

A motor 18 is mounted to the bed with configurable headboard 100 and is operably coupled to the headboard 10. The motor 18 is a conventional electric motor and is operable to move the headboard 10 intermediate its first position and second position. While a motor 18 is illustrated and discussed herein for moving the headboard 10, it is contemplated within the scope of the present invention that the headboard 10 could be manually moved intermediate its first position and second position.

The sink 30 is mounted to the headboard 10 utilizing suitable durable techniques. The sink 30 is constructed in a manner so as to provide a first position and a second position. In a preferred embodiment illustrated herein, the sink 30 includes a body 31 that is manufactured in an undulated modified z-fold manner wherein the body 31 is tapered inward from the first end 32 to the second end 33. The aforementioned shape of the body 31 enables the sink 30 to be folded into its first position as illustrated herein in FIG. 1. When the body 31 of the sink 30 is folded into its first position this facilitates the ability for the headboard 10 to be placed in its first position wherein the headboard 10 can be adjacent a wall or other structure in a room in which the bed with configurable headboard 100 is disposed.

Figure 3:
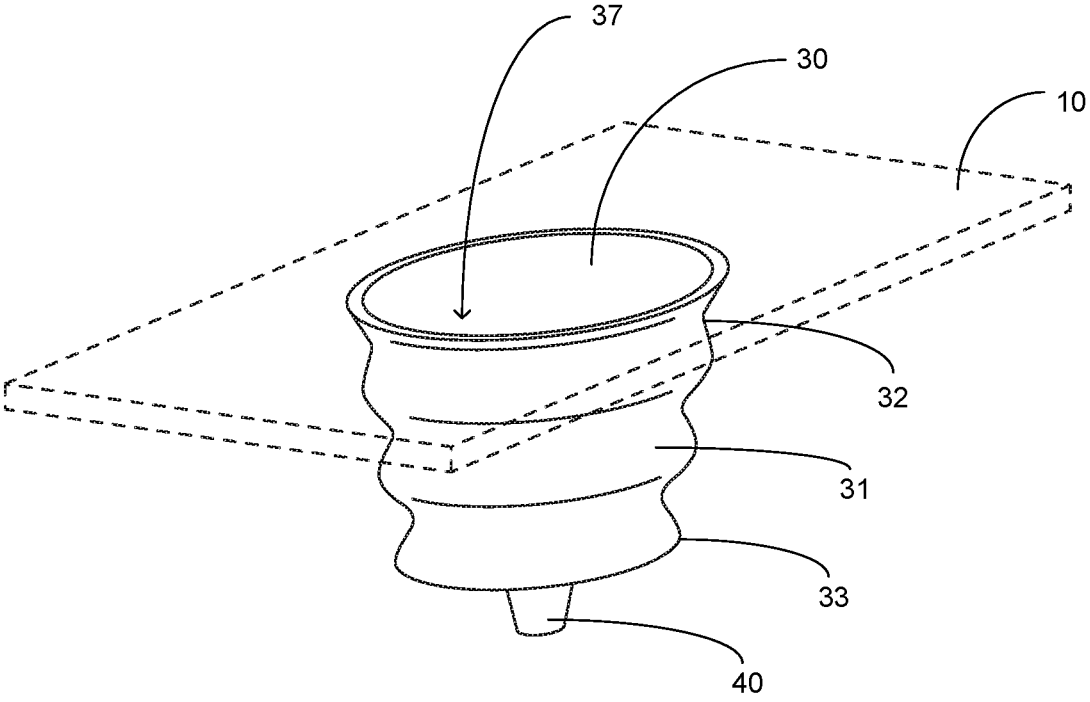
FIG. 3 is a detailed view of the headboard of the present invention.

The second position of the sink 30 is illustrated in detail in FIG. 3 submitted herewith. Ensuing the headboard 10 being moved to its second position, the sink 30 can be transitioned to its second position. In the second position of the sink 30 the second end 33 is extended downward away from the first end 32. As previously mentioned herein, the shape of the body 31 facilitates the transitioning between the first position and the second position. While a specific construction of the body 31 has been disclosed herein, it is contemplated within the scope of the present invention that the body 31 could be constructed in alternate manners in order to achieve the desired functionality described herein. More specifically but not by way of limitation, the body 31 could be comprised of a plurality of telescoping segments sealably coupled.

Located at the second end 33 of the body 31 is the discharge nozzle 40. Discharge nozzle 40 is integrally formed with the second end 33 of the body 31 utilizing suitable durable techniques. The discharge nozzle 40 includes a hollow passage therethrough (not particularly illustrated herein) that facilitates the drainage of water from the interior volume 37 of the sink 30. The discharge nozzle 40 is tapered in design and it is contemplated within the scope of the present invention that the discharge nozzle 40 could be operably coupled to various receptacles and/or plumbing in order to facilitate removal of water.

While the sink 30 has been illustrated herein being oval in shape, it is contemplated within the scope of the present invention that the sink 30 could be formed in alternate shapes and/or sizes. Furthermore, while not particularly illustrated herein, it is further contemplated within the scope of the present invention that the sink 30 could further include a cover releasably secured thereto wherein the cover would be utilized when the headboard 10 is in its first position and the sink 30 is not in use.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A headboard wherein the headboard is operably coupled to a bed and is provided to facilitate hygienic tasks wherein the headboard comprises:

a body, said body of the headboard being planar in manner, said body having a first end and a second end, said body having an upper edge and a lower edge, said body being movably coupled to a bed, said body being movable intermediate a first position and a second position, wherein in the second position of the body of the headboard the body is oriented in a horizontal manner;

a sink, said sink being mounted in said body of the headboard, said sink configured to have a first position and a second position, said sink being in a collapsed position in the first position thereof, wherein the sink is extended outward from the body of the headboard in its second position and wherein in the first position of the body of the headboard the body of the headboard is in a vertical orientation;

a discharge nozzle, said discharge nozzle being mounted to said sink, said discharge nozzle configured to allow water to egress from said sink;

a motor, said motor being operably coupled to the headboard, wherein the motor is configured to move the body of the headboard intermediate its first position and second position; and wherein the sink is placed in its first position when the body of the headboard is moved to its first position and wherein the body of the headboard is moved to its second position when the sink is placed in its second position.

2. A headboard that is hingedly coupled to a bed and is movable intermediate a first position and a second position in order to facilitate execution of hygienic tasks for a person disposed in the bed wherein the headboard comprises:

a body, said body of the headboard being planar in manner, said body having a first end and a second end, said body having an upper edge and a lower edge, said body being rectangular in shape, said body being hingedly coupled to a bed proximate the lower edge of the body, said body being movable intermediate a first position and a second position, wherein in said first position said body of the headboard is in a vertical orientation, wherein in the second position of the body of the headboard the body of the headboard is in a horizontal orientation;

a sink, said sink being mounted in said body of the headboard, said sink further including a body, said body of said sink having a first end and a second end, said body of said sink being tapered from said first end of said body of said sink to said second end of said body of said sink, said body of said sink being formed in a structure and from a material so as to facilitate moving of the sink between a first position and a second position, wherein in the second position of the body of the sink the body of the sink is extending downward from the body of the headboard and wherein said body of said sink is moved to said second position thereof ensuing said body of the headboard being placed in its second position;

a discharge nozzle, said discharge nozzle being proximate the second end of said body of said sink, said discharge nozzle extending outward from said second end of the body of said sink, said discharge nozzle configured to provide removal of fluid from said sink;

a motor, said motor being operably coupled to said headboard, wherein the motor is configured to move said body of the headboard intermediate its first position and its second position; and wherein the sink is placed in its first position when the body of the headboard is moved to its first position.

* * * * *